US005836585A

United States Patent [19]

LaCivita

[11] Patent Number: 5,836,585

[45] Date of Patent: Nov. 17, 1998

[54] BOARD GAME WITH PLAYING CARD HOLDER

[75] Inventor: Robert LaCivita, Phoenix, Ariz.

[73] Assignee: N-Fuego, LLC, Phoenix, Ariz.

[21] Appl. No.: 812,238

[22] Filed: Mar. 6, 1997

[51] Int. Cl.[6] ..... A63F 3/00

[52] U.S. Cl. ..... 273/287; 273/298; 273/309; 273/244.2

[58] Field of Search ..... 273/298, 309, 273/150, 148 A, 287, 244, 244.1, 244.2, 281, 283, 284, 236, 242, 243, 277, 278

[56] References Cited

U.S. PATENT DOCUMENTS

| | | | |
|---|---|---|---|
| 2,001,918 | 5/1935 | Nevius | 273/309 |
| 2,204,822 | 6/1940 | Quillin et al. | 273/148 A |
| 2,624,582 | 1/1953 | Molinar | 273/150 |
| 2,655,736 | 10/1953 | Lipschitz | 273/150 |

FOREIGN PATENT DOCUMENTS

| | | | |
|---|---|---|---|
| 495614 | 9/1950 | France | 273/148 A |

*Primary Examiner*—William M. Pierce
*Attorney, Agent, or Firm*—LaValle D. Ptak

[57] ABSTRACT

A board game includes a main flat board member having a rectangular upper surface and player positions located at each edge of the board. A card holder display device is located at each of the player positions for aligning and removably displaying a predetermined number of flat rectangular cards, such as sports trading cards. The display device has individual compartments for each of the cards, and is constructed to permit insertion and removal of cards individually into each of the compartments. A transparent cover is provided for the cards located at each of the player positions; so that the cards are visible during the play of the game.

3 Claims, 3 Drawing Sheets

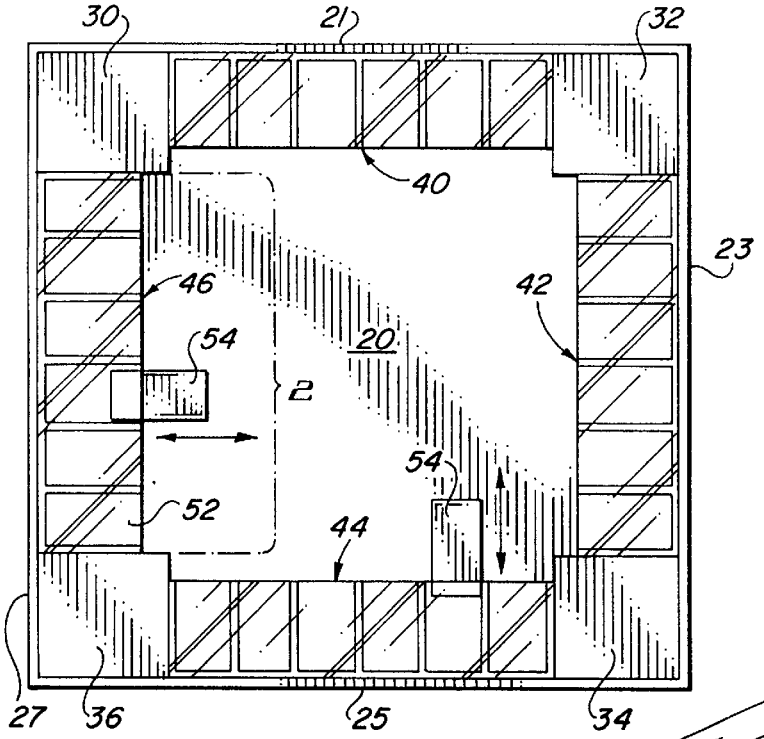
FIG. 1
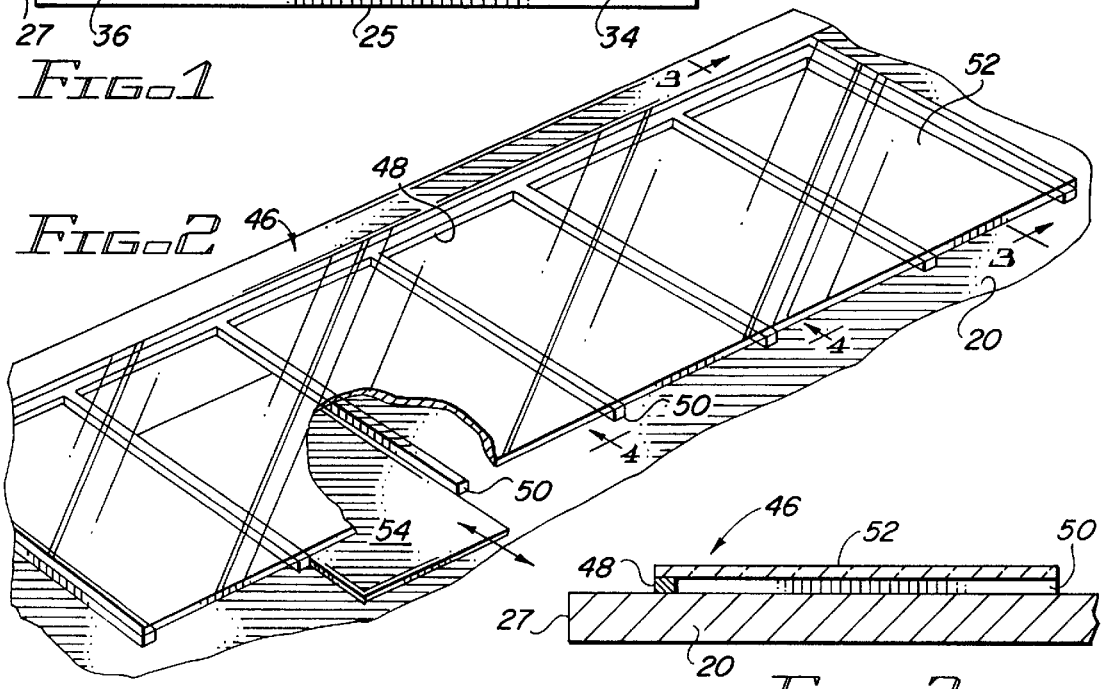
FIG. 2
FIG. 3
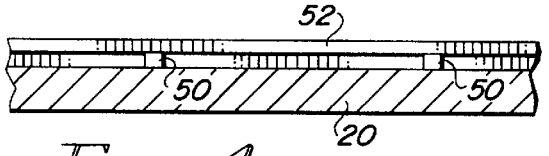
FIG. 4
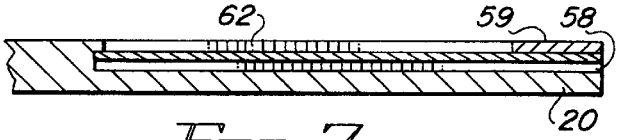
FIG. 7

BOARD GAME WITH PLAYING CARD HOLDER

BACKGROUND

Board games of many types are in existence today. Typically, such board games involve a pathway of playing spaces illustrated on the face of the board; and players advance separate playing pieces in accordance with instructions on decks of playing cards or by rolling dice. Other games utilizing playing cards also are widely popular. Such games include poker, bridge, "Old Maid", canasta, and the like.

Whether typical board games are played or typical card games are played, generally there is no exchange of any items between the players, with the exception of games like poker where bets are made and chips or money exchange hands. For the most part, however, the games are played with the purpose of accumulating points, with the winner determined by the player holding the most points at the end of the play. Alternatively, the player first reaching a preestablished number of points frequently is declared the winner.

A hobby which is attracting increasingly large numbers of participants is the collection of sports and entertainment industry "trading cards". The earliest versions of these cards depicted the players for different professional baseball teams. These early "baseball cards" and current sports cards covering all of the major sports, and cards providing pictures and information of entertainment personalities, are widely dispersed and traded today. The popularity of sports trading cards has expanded from the trading of such cards by school children to the accumulation of specific collections of cards by serious collectors.

It is desirable to provide a board game with a structure of the playing board designed to accommodate and display trading cards for use in the play of a trading card game.

SUMMARY OF THE INVENTION

It is an object of this invention to provide an improved game.

It is another object of this invention to provide an improved board game.

It is an additional object of this invention to provide an improved board game capable of displaying playing cards used by the game participants.

It is a further object of this invention to provide an improved board game having playing card holder display devices at each of the playing positions for holding and releasably displaying playing cards in a predetermined arrangement at each of the player positions.

In accordance with a preferred embodiment of the invention, a board game includes a flat board member having a playing surface and at least two opposing player positions on it. A card holder display device is located at each of the player positions for aligning and removably displaying a predetermined number of flat rectangular playing cards, which preferably are sports trading cards or the like. These cards are displayed in a predetermined arrangement at each of the player positions.

BRIEF DESCRIPTION OF THE DRAWING

FIG. 1 is a top view of a preferred embodiment of the invention;

FIG. 2 is a perspective view of the portion of FIG. 1 indicated by the dot-dash line 2 of FIG. 1;

FIG. 3 is a cross-sectional view taken along the line 3—3 of FIG. 2;

FIG. 4 is a cross-sectional view taken along the line 4—4 of FIG. 2;

FIG. 7 is a cross-sectional view taken along the line 7—7 of FIG. 6;

DETAILED DESCRIPTION

Figure 11:
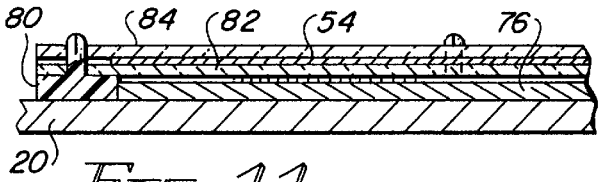
FIG. 11 is an assembled cross-sectional side view of the embodiment shown in FIG. 10.

Reference now should be made to the drawing in which the same reference numbers are used throughout the different figures to designate the same components. FIG. 1 illustrates a rectangular (preferably square) game playing board 20, which has four player positions located adjacent the four edges 21, 23, 25 and 27. The four corners of the board have areas designated as 30, 32, 34 and 36. Between these areas, adjacent the edges at the player positions, are card holder display devices 40, 42, 44 and 46, which are illustrated in FIG. 1 as each capable of holding six playing cards 54 for display to all of the players.

FIG. 2 illustrates one version of the card holder display device 46 shown in FIG. 1. This card holder display is capable of holding six rectangular cards 54 between the upper or playing surface of the board 20 and a top transparent cover 52, which may be made of any suitable thin transparent material, such as plastic or glass. The spaces or compartments for the individual cards are defined by dividers 50; and the outer edge of the compartments is defined by a border 48, as illustrated in FIG. 2.

The compartments thus formed are enclosed on all sides except the inner edge facing toward the center of the game board 20. Thus, it is possible to insert and remove cards 54, as indicated by the arrows in both FIGS. 1 and 2, to place desired cards 54 within each of the six compartments. Typically, the cards which are used are sports or entertainment trading cards of interest to all of the players. Each player inserts cards of his or her choice into the six slots, where the cards remain on display during the play of the board game. FIGS. 3 and 4 illustrate the side cross-sectional and end cross-sectional relative dimensions of the various compartments which are formed by the structure illustrated in FIG. 2.

Figure 5:
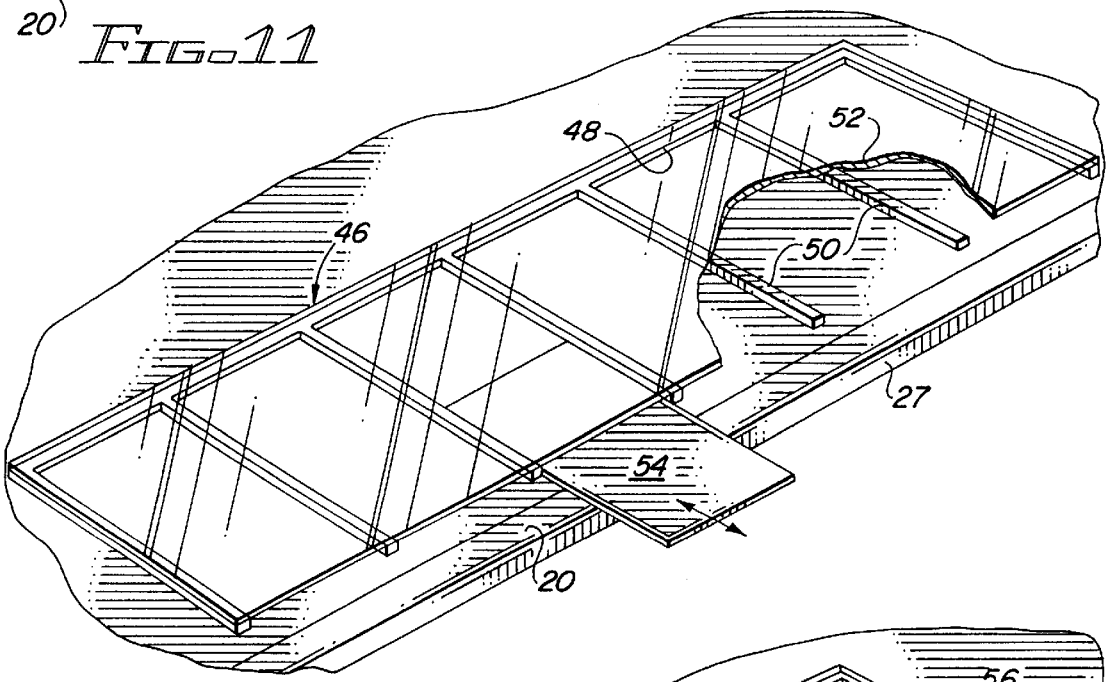
FIG. 5 is an alternative to the portion of the embodiment shown in FIG. 2.

FIG. 5 is an embodiment which is similar to that of FIG. 2, but in which the open edge of the compartments is located adjacent the outer edge (the one facing the player) of the game board 20. In all other respects, the structure of the embodiment shown in FIG. 5 is the same as the structure of the embodiment of FIG. 2. It is apparent, however, that with the embodiment of FIG. 5, cards are inserted into the compartments and withdrawn from the compartments from the position at the outer edge 27 (for example) of the game board 20. It also should be noted that the card holder display devices which are shown in both FIGS. 2 and 5 are used in all four of the playing positions 40, 42, 44 and 46 of the structure shown in FIG. 1. Only one of these devices is illustrated in detail, since the structure is the same for all four.

Figure 6:
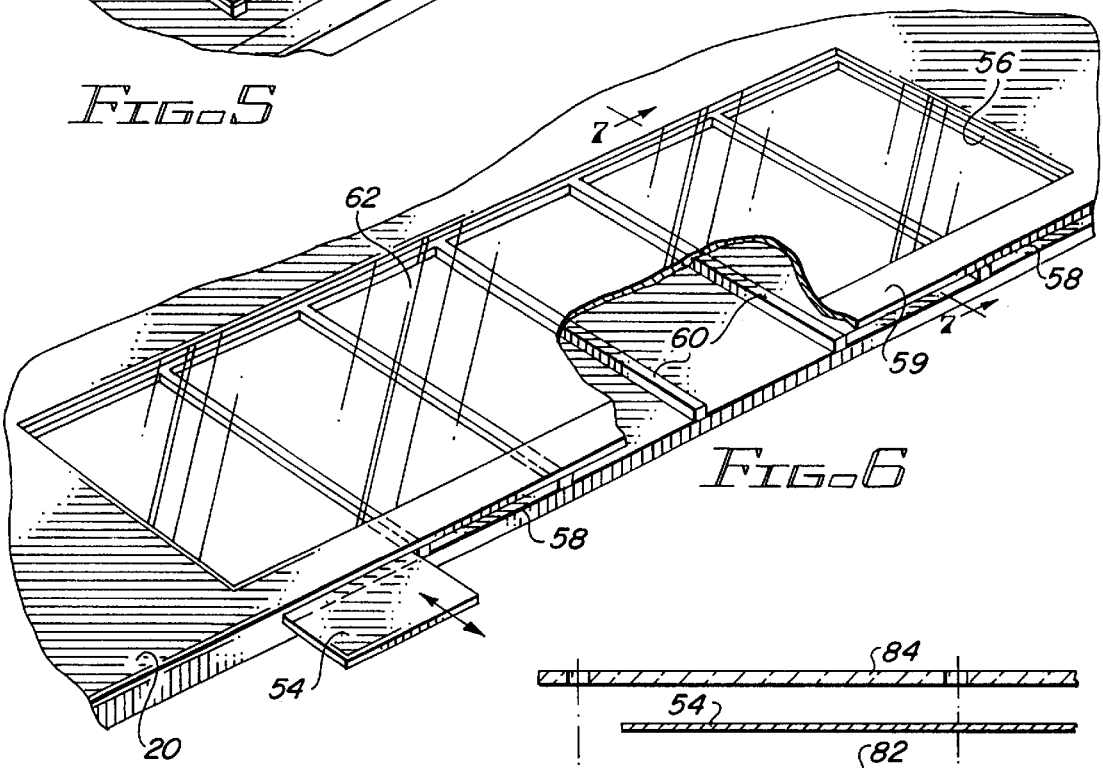
FIG. 6 is another alternative embodiment of the invention.

FIGS. 6 and 7 illustrate an alternative to the structure of FIGS. 2 and 5. With the embodiments shown in FIGS. 2 and 5, the card holder display devices are attached to the upper surface of the board 20; so that the card holder display compartments extend above this upper surface. In the embodiment shown in FIGS. 6 and 7 the card holder display devices are "built-in" the board 20; so that the surface of the transparent cover 62 is in the same plane as the upper surface of the board 20. To accomplish the structure which is shown in FIG. 6, a recess 56 is formed in the board, spaced a short distance from the edge. This leaves a lip 59 along the edge of the board 20, which is a contiguous part of the upper surface of the board 20. A slot 58 then is formed in the edge of the board along the width of the recess 56, as shown in both FIGS. 6 and 7. The six compartments then are defined by five dividing ribs or dividers 60, which are similar to the ribs 50 of the embodiments shown in FIGS. 2 and 5. The structure then is completed by securing a transparent cover 62, made of plastic or glass, on the upper edges of the dividers 60. Trading cards, or playing cards 54 then may be inserted into or removed from the compartments formed by the dividers 60 by sliding them in the direction of the double-ended arrow shown in FIG. 6.

Figure 8:
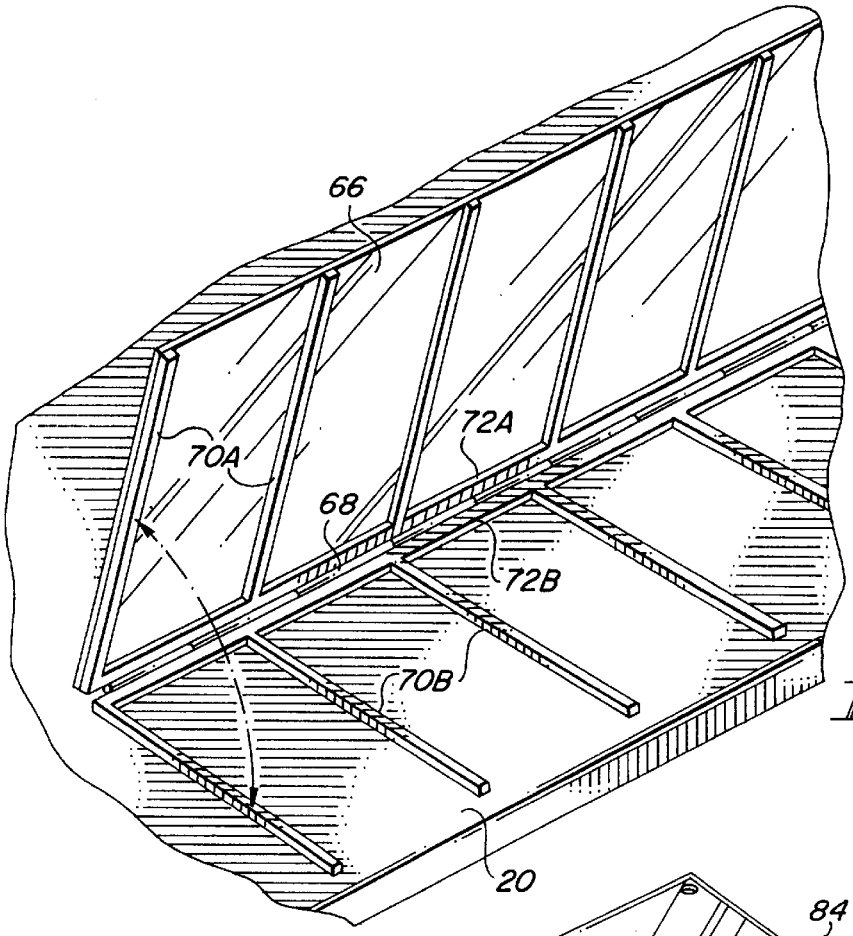
FIG. 8 is an additional alternative embodiment of the invention.

FIG. 8 illustrates yet another variation which may be used to form the compartments for holding the trading cards or playing cards during the play of the game. Once again, the compartments are the same size as in the other embodiments described previously; and they are defined by means of dividers or ribs 70B, which are secured to the upper surface of the board 20 at the various playing positions illustrated in FIG. 1. The compartments may be open on one edge, as shown in FIG. 8, or they may be enclosed on all four edges, since access to the compartments is obtained by a hinged cover having mating ribs 70A on it for supporting the transparent cover sheet 76 (again, made of plastic or glass) as shown in FIG. 8. By moving the hinged cover on the hinge 68 to the position shown in FIG. 8, the compartments all are opened simultaneously to permit placement or removal of trading cards or playing cards from each of the various compartments formed by the mating ribs 70A/70B. When the cover is rotated clockwise (as viewed in FIG. 8) to the position where the ribs 70A directly overlie the ribs 70B, the structure which results is similar in appearance to the embodiment shown in FIG. 5.

Figure 10:
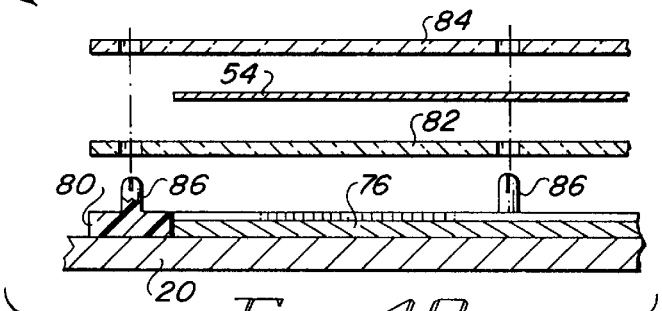
FIG. 10 is a partially exploded cross-sectional side view of the embodiment shown in FIG. 9.
Figure 9:
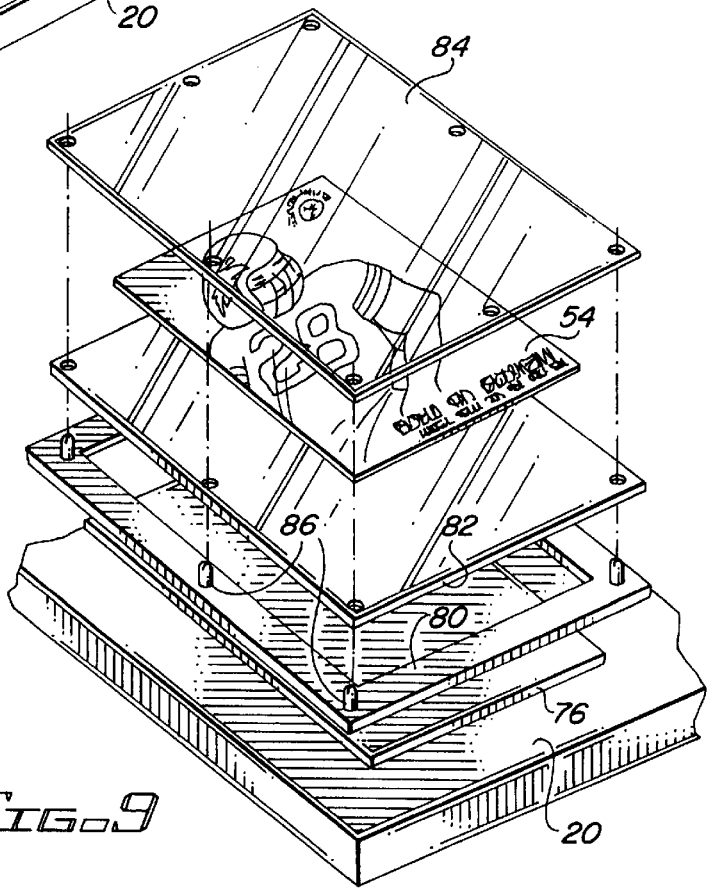
FIG. 9 is an exploded view of yet another embodiment of the invention.

FIGS. 9, 10 and 11 illustrate yet another variation which may be used for removably holding and displaying playing cards 54 at each of the playing positions 40, 42, 44 and 46 of FIG. 1. Instead of building a single six-compartment card holder and display device for each of the four positions, as is the case of all of the foregoing embodiments, the embodiment of FIGS. 9, 10 and 11 places raised rectangular regions or areas 76 in each of the six card holding positions on the upper surface of the game board 20. These raised rectangular regions 76 are located in a side-by-side arrangement in the same configuration illustrated for the playing positions 40, 42, 44 and 46 of FIG. 1.

The cards 54 then are carried in a suitable plastic holder, one version of which is shown in exploded view in FIG. 9, as including a pair of transparent cover sheets 82 and 83, which sandwich a card 54 between them. The sheets 82 and 83 are attached to an open rectangular frame 80 by means of integral pins 86, which extend through mating holes on the sheets 82 and 84 to securely hold the trading card 54 in place as an integral part of the assembled holder and transparent cover sheets or plates 82 and 84, as illustrated in the partially exploded cross-sectional view of FIG. 10 and in the assembled cross-sectional view of FIG. 11. It is to be noted that the opening or recess in the frame 80 is selected to conform to the outer dimensions of the raised region 76; so that when the card/frame assembly is placed over the raised region 76, the frame assembly is held against lateral movement by means of the inner edge of the frame 80 engaging the outer edge of the raised portion 76 at each of the playing positions. Other card holders using standard plastic cases with an outer ridge on them also may be used to fit over the raised portions 76 to permit individual placement of assembled cards and holders on each of the raised portions 76 for the play of the game. The particular version which is illustrated in FIG. 9 simply illustrates the principle of using the raised area 76 to be engaged by an outer border flange or ridge on a card holder of some type.

It is readily apparent that when trading cards are placed in each of the card holders at each of the player positions, they readily may be observed by all of the players engaged in the game. The cards removably inserted into the card holders, or individually encased cards of the type illustrated in FIGS. 9, 10 and 11, typically will be chosen in accordance with some particular sports symbol or as agreed upon in advance by the players. It is envisioned that all of the trading cards which have been placed in the game board card holders, or which have been placed on the raised portions 76, by the players, represent a "pot". The winner of the game then receives all of the cards in the "pot".

A variety of different rules may be used to play the game; and game pieces may be moved in accordance with a predetermined pattern for establishing points at the roll of dice or by some other means. In whatever way points are determined, however, the object of a typical game is for a player to accumulate the most points or to be the first one to reach an agreed upon point goal; whereupon the winning player collects all of the trading cards (or other playing cards) which have been placed in the card holder display devices.

The foregoing description of the preferred embodiments of the invention should be considered as illustrative and not as limiting. For example, each of the various embodiments, including FIG. 1, show six card holder display compartments for each of the four playing positions on the four sides of the game board 20. Clearly, a greater number or lesser number of card holders may be used; and the particular side-by-side elongated rectangular pattern which has been illustrated at the various playing positions could be changed without departing from the scope of the invention. The board and the card holder display devices which are used may be made of various materials, as desired. Various other changes and modifications will occur to those skilled in the art for performing substantially the same function, in substantially the same way, to achieve substantially the same result without departing from the true scope of the invention as defined in the appended claims.

What is claimed is:

1. A board game including in combination:

a main flat board member having at least two opposing player positions on an upper surface thereof with a predetermined number of card positions at each of said player positions;

card holder devices at each of said player positions comprising a plurality of rectangular raised areas corresponding to each of said predetermined number of card positions in a predetermined arrangement on said upper surface of said flat board member;

a plurality of separate removable individual containers, each for containing a card therein and each having a rectangular recess therein corresponding to said rectangular raised areas for location thereon, for aligning and removably displaying a predetermined number of flat rectangular cards in a predetermined arrangement at each of said player positions; and wherein each of said containers is transparent at least on one surface thereof to permit viewing of a card contained therein.

2. The combination according to claim 1 wherein said main flat board member has four sides, with four player positions located adjacent each of the four sides thereof.

3. The combination according to claim 1 wherein said flat board member has said opposing player positions located on opposite sides of said upper surface.

* * * * *